United States Patent [19]

Imai

[11] Patent Number: 4,872,779

[45] Date of Patent: Oct. 10, 1989

[54] JOINT DEVICE OF STRUCTURE MEMBER

[75] Inventor: Katsuhiko Imai, Ashiya, Japan

[73] Assignee: Kawatetsu Kenzai Kogyo Kabushiki Kaisha, Hyogo, Japan

[21] Appl. No.: 187,662

[22] PCT Filed: Mar. 4, 1987

[86] PCT No.: PCT/JP87/00137

§ 371 Date: Mar. 29, 1988

§ 102(e) Date: Mar. 29, 1988

[87] PCT Pub. No.: WO88/01323

PCT Pub. Date: Feb. 25, 1988

[30] Foreign Application Priority Data

Aug. 19, 1986 [JP] Japan ..... 61-193059

[51] Int. Cl.[4] ..... F16D 1/00

[52] U.S. Cl. ..... 403/171; 403/176

[58] Field of Search ..... 403/171, 176, 170, 172

[56] References Cited

U.S. PATENT DOCUMENTS 4,664,550 5/1987 Jachmann ..... 403/171

FOREIGN PATENT DOCUMENTS 2246478 4/1973 Fed. Rep. of Germany ..... 403/171
58-7046 1/1983 Japan .
60-30742 2/1985 Japan .
61-123102 8/1986 Japan .
61-261545 11/1986 Japan .
676701 8/1979 U.S.S.R. ..... 403/171

*Primary Examiner*—Andrew V. Kundrat
*Attorney, Agent, or Firm*—Lowe, Price, LeBlanc, Becker & Shur

[57] ABSTRACT

A device for joining elongate structure members to connector nodes includes a bolt having oppositely threaded ends for threaded engagement with a nut at one end and a connector node at the other end. Between its threaded ends the bolt has a cylindrical portion and a torque transmitting portion. An externally threaded bolt-support member engageable with internal threads at the end of the structure member slidingly receives the cylindrical portion of the bolt while a sleeve with an internal aperture non-rotatably but slidingly receives the torque-transmitting portion of the bolt. In use, the nut prevents the bolt from pulling out of the bolt-support member while external torque applied to the sleeve tightens the structure member to the connector node. An elastic sealing member around the bolt is squeezed between the connector node and the torque-transmitting portion of the bolt and this may be supplemented by sealing material applied at the interface between the sleeve and the structure member end. The critical components of the combination, especially the threads thereof, are thus protected against ambient corrosion and a strong, durable, easily made connection is provided for highly loaded structures.

21 Claims, 8 Drawing Sheets

JOINT DEVICE OF STRUCTURE MEMBER

TECHNICAL FIELD OF THE INVENTION

This invention relates to a device for joining structure members and, more particularly, to a device for assembling a truss structure by easily and tightly joining structure members, such as plural long pipes, to nodes.

BACKGROUND OF THE PRIOR ART

In constructing a large structure, e.g., a large truss, from many structure members such as long steel pipes, each structure member is typically joined to nodes in order to assemble, for example, a truss structure. The typical structure member is joined to polyhedral nodes by bolting at both ends thereof. In Japanese Utility Model Publication of No. 42-22992, a joint device is proposed to form a truss structure. This device is explained as follows: a nut is provided with a hole along a radius thereof and a pin, which is attached to a bolt engaged with the nut, is put into the hole, the bolt is rotated through the pin by rotating the nut. Consequently, the maximum torque that can be applied depends on the strength of the pin and, therefore, it is difficult to tighted the bolt fully when the structure member is joined to the nodes. Moreover, it is impossible to torque fully on the bolt because of holes or hollows that are formed in some structural elements of the joint device. Also, the bolt, which is important in terms of durability, is exposed in part to the atmosphere, hence excess strength and quality of the bolt will be required to ensure durability against atmospheric corrosion.

In Japanese Patent Publication No. 56-29064, a device is disclosed which requires rotation of a bolt through a sleeve covering the bolt. When such a structure member composed of a long structure pipe and edge covers is manufactured, each bolt is fixed to the edge covers welded at the ends of structure pipe. Modifying the length of structure member, determined somewhat by its warp in welding, is impossible and hence the length thereof may be undesirable. If there is failure to absorb such size errors in assembling the truss structure, some of the structure members will not be usable. If a size-adjuster is included in a joint device, the mechanism of the joint device will be very complicated. Furthermore, the opening at the end of the typical structure member is limited with regard to the structural elements of the joint device being small. Therefore, it would be difficult to galvanize homogeneously all surfaces inside and outside of the long structure members and they may corrode.

An object of this invention is to propose a device for joining of structure members in assembling a truss structure by using structure members and nodes.

Another object is to provide a joint structure member to a node tightly, to realize a structure in which bolts do not corrode, to provide an adjustment in order to size a desirable exact length of a structure member, and to provide firm and simple structural elements without holes and hollows.

SUMMARY OF THE INVENTION

This invention relates to a device for joining or connecting an end of an elongate pipe-like structure member that has an internally threaded end ending at a first contact surface to a connector node that has an internally threaded aperture ending at the second contact surface. The device includes a bolt with oppositely threaded end portions, one of which is adapted to engage directly with the threaded aperture of the node and, intermediate between the threaded portions, a cylindrical portion and a torque transmitting portion. An annular cylindrical bolt support member having an internal bore adapted to slidingly receive therethrough the other threaded portion and a cylindrical portion of the bolt is externally threaded to engage with the internal threads of the structure member end. A nut means engaging the threaded portion that passes through the bolt support member is provided and is large enough to prevent the bolt from slipping out when the nut means is applied. A sleeve member is disposed around the bolt member and has an internal bore adapted to slidingly receive the torque transmitting portion of the bolt, and the sleeve member during use makes contact with the contact surface of the structure member end on one side and the external surface of the node on the other side. The sleeve member has an outer surface adapted to engage with a torque applying tool, whereby torque may be applied to tighten the connection so obtained.

An exact length for the structure member may be obtained by machining a portion of the end as necessary.

In another aspect of this invention, a spring disposed around the cylindrical portion of the bolt applies a bias force tending to separate the torque transmitting portion of the bolt from the end of the structure member. In another aspect of the invention, sealing means are provided at both ends of the sleeve member so that, during use, ambient moisture, corrosive gasses and the like are excluded and the threads of the bolt are thus protected from corrosion during prolonged use.

BEST MODE FOR PRACTICING THE INVENTION

Figure 1:
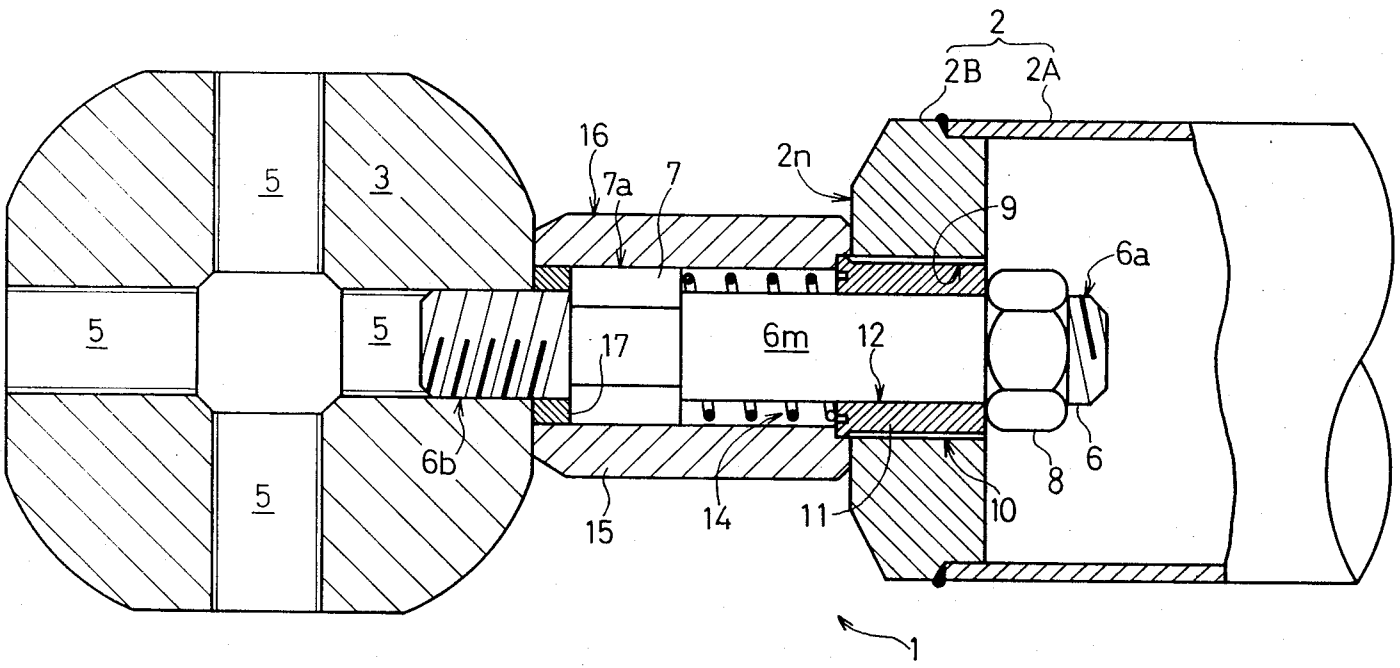
FIG. 1 is a sectional view of the device in a preferred embodiment of the present invention.

Referring to FIG. 1, it is seen how a plurality of structure members 2 are typically jointed radially to polyhedral nodes 3. The structure member 2, in a preferred embodiment, comprises a length of structure pipe 2A, e.g., a long pipe or the like, and edge covers 2B which have the same outer diameter as that of structure pipe 2. An edge cover 2B is usually welded at each end 2A of the structure pipe to form a structure member 2. A fastening bolt 6, for jointing the structure member 2 to the node 3, which provides screw holes 5 therefor, is fitted to the edge cover 2B. The total or overall length of structure member 2, including both edge covers 2B, should be exact. Fastening bolt 6 is not fitted to the structure member 2 prior to the completion thereof and, accordingly, the desirable exact length from an end face 2n of the edge cover 2B to that of an edge cover at the other end, can be sized by machining, e.g., cutting.

Fastening bolt 6 is provided with a boss 7 and counter-spiral screws, i.e., oppositely threaded portions 6a, 6b at opposite ends thereof. Torque transmitting surfaces 7a are formed on the outside of the boss 7 in order to facilitate rotating the fastening bolt 6, one screw portion 6b is right-handed and the other is left-handed. Therefore, an anchor nut 8 that is engaged, for example, with screw 6a, will never loosen from the fastening bolt in the structure member 2 during rotation of the fastening bolt 6 when the structure member 2 is joined to the node 3 by threading therein of end 6b.

A threaded screw hole 9, having a diameter larger than that of the anchor nut 8, is formed in said edge cover 2B. A supporting member 11 provided with a screw or outside thread 10 is thereby threadedly engaged with said screw hole 9 (as best seen in FIG. 1), and an adhesive agent is applied to said screw 10 so as not to loosen thereafter. A sliding hole 12, formed in supporting member 11 for supporting therein a slidable body portion 6m of fastening bolt 6, is formed in the center of the supporting member 11. Nevertheless, it is not necessary that the supporting member 11 should be accommodated perfectly in the edge cover 2B. It is sufficient that the supporting member 11 support the fastening bolt 6, as shown in the figures, without disturbing the rotation of after-mentioned sleeve 15.

Note that the external threading on supporting member 11 can be optionally provided, as described along a portion of its length (per FIGS. 1–11) or along the entire length of supporting member 11 (per FIGS. 12 and 13) according to this invention.

Figure 2:
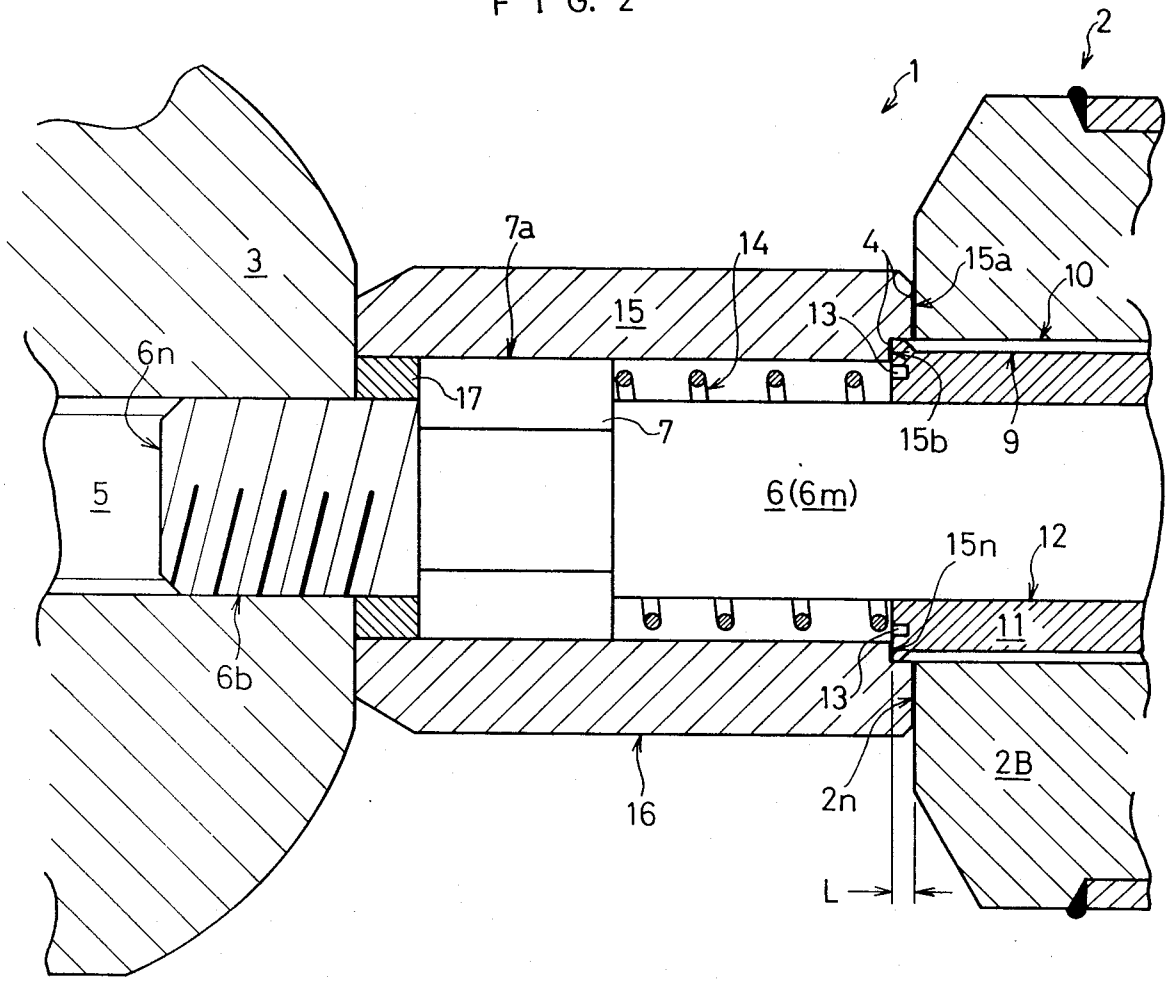
FIG. 2 is an enlarged sectional view of key elements of the device per FIG. 1.

In the preferred embodiment, an end of supporting member 11 projects from the edge cover 2B by a length identified as L, shown in FIG. 2. The degree of engaging therewith, i.e., L, being adjustable during the fitting operation when the coacting parts are assembled, ensures that watertightness which prevents the fastening bolt 6 from eroding is promoted, as described later. Hollows 13, with which the pins of a rotating tool 18 (seen in FIG. 5) are to be engaged, are formed in the preferred embodiment on the supporting member 11 for the purpose of engaging supporting member 11 with the screw hole 9 of edge cover 2B, as best seen in, for example, FIGS. 1, 2, 12 and 13. As indicated in FIGS. 3–11, however, this is not essential, i.e., supporting member 11 may be threaded into edge cover 2B by hand.

The slidable body 6m of fastening bolt 6 is inserted beforehand into sliding hole 12 of supporting member 11 and, thereafter, the anchor nut 8 is engaged with the screw portion 6a, and this subassembly of the device is fitted to the edge cover 2B through the threading thereto of supporting member 11. A spring 14 is provided between the supporting member 11 and the boss 7 of fastening bolt 6. This spring 14 is a coil-spring and encircles the slidable body 6m. The spring 14 contracts when the boss 7 moves toward the edge cover 2B, so that the boss 7 will be biased by spring 14 to be pushed toward the node 3. When the fastening bolt 6 is engaged sufficiently with the screw hole 5 of node 3, the spring 14 may expand completely, because the spring 14 need not push the boss 7 thereafter. Consequently the elasticity of spring 14 is selected to be enough to push the bolt 6 toward the node 3 as long as the end tip 6n of screw 6b is located at least within a sleeve 15 as discussed hereinafter.

The sleeve 15, which at its inside engages with the outside torque transmitting surfaces 7a of boss 7 in order to transmit a rotation thereto, is fitted to the outside of fastening bolt 6. The sleeve 15 is, for instance, a hexagonal tube which covers the correspondingly sized hexagonal boss 7, and the inside of sleeve 15 is an unvaried sectional figure so as to allow movement of boss 7 therein along an axial direction thereof. On the outside of sleeve 15, torquing surfaces 16 are provided to facilitate rotation thereby of boss 7. The boss 7 and the sleeve 15 are generally hexagonal figures, but any polygonal section, e.g., a quadrilateral may be adopted. In brief, it is sufficient if the torquing surfaces 16 can be rotated by wrench or the like engaged therewith. The length of sleeve 15 is manufactured exactly, similarly to the structure member 2.

After joining of the structure member 2 to the node 3, as described, the sleeve 15 always covers the fastening bolt 6, therefore, the fastening bolt 6 is not exposed to atmosphere and waterdrops do not attach thereto. In order to further promote the watertightness in this embodiment, watertight mechanisms as shown in FIG. 2 are adopted between the sleeve 15 and the edge cover 2B, and between the sleeve 15 and the node 3. A ringed groove 15n, wherein the end of supporting member 11 is inserted, is formed inside the end of sleeve 15 on the side adjacent to edge cover 2B. The degree of engaging with the supporting member 11 is adjusted correspondingly to the depth of the ringed groove 15n, so that the end face of supporting member 11 may also contact with the wall 15b of sleeve 15 within ringed groove 15n when the end face 15a of sleeve 15 contacts with the end face 2n of edge cover 2B. Furthermore, a sealing material 4, e.g., a highly polymerized absorbent, may be applied thinly on the contacting surfaces thereof. The highly polymerized absorbent will expand by absorbing moisture, and excellent watertightness can thus be attained. When the structure member 2 is jointed to the node 3 by rotating sleeve 15, the joining force between the node 3 and the structure member 2 is transmitted through said two contacting surfaces.

Also, an elastic packing 17 may be disposed around the screw 6b close to the boss 7. The thick elastic packing 17 is compressed by the boss 7 when the fastening bolt 6 is engaged with the screw hole 5 of node 3 by means of rotating sleeve 15, and improved watertightness between the node 3 and the sleeve 15 can thus be realized. Thus, sealing of both ends of sleeve 15 prevents water or air from entering into the sleeve 15 and, accordingly the joining device will be suitable for prolonged use.

The process of joining structure member 2 to node 3 is as follows. Edge covers 2B are welded to both ends of structure pipe 2A which is cut to a predetermined length. Warping during welding may cause undesirable changes in the length of structure member 2; however, by machining of cutting end face 2n of edge cover 2B, the overall length of structure member 2 can be made exact as desired. The length of screw hole 9 can be made a little shorter, but it should not have a harmful influence on the device. The relatively large opening of screw hole 9 in the edge cover 2B makes possible an easy and smooth flow of a surface treatment liquid into the structure member 2 composed of structure pipe 2A and edge covers 2B. Consequently, surface treatments for anti-corrosion, e.g., oxygen washing, zinc phosphate treatment of under-coating, baking of final coating and zinc galvanizing, art performed satisfactorily on the inside as well as the outside of structure member 2.

Figure 3:
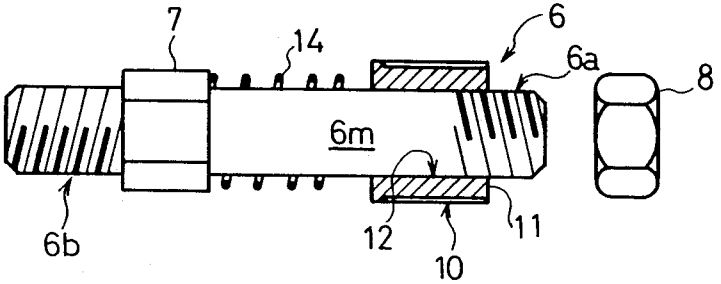
FIG. 3 through FIG. 10 are sectional views at different stages of assembling of the device.
Figure 4:
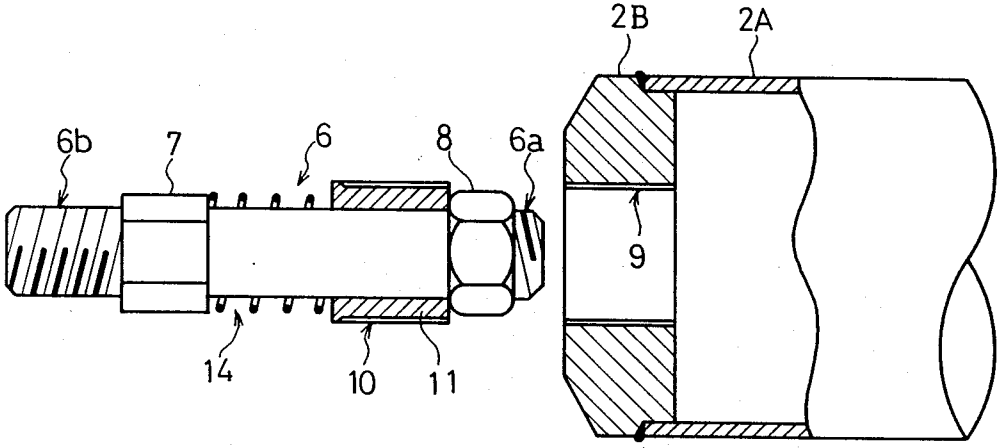
Figure 5:
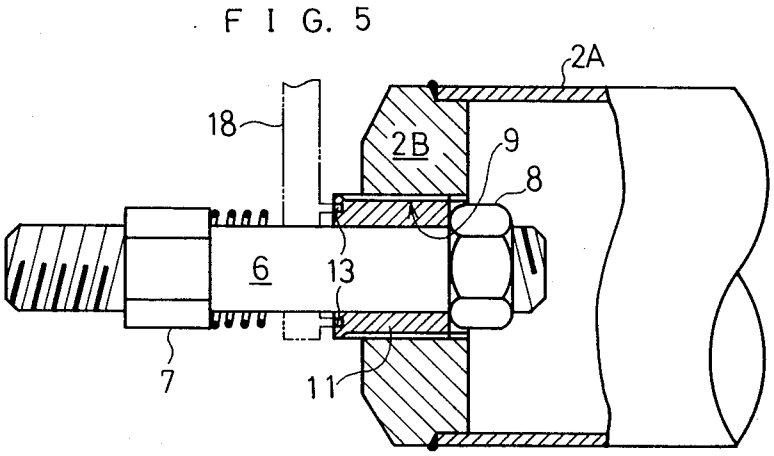
Figure 6:
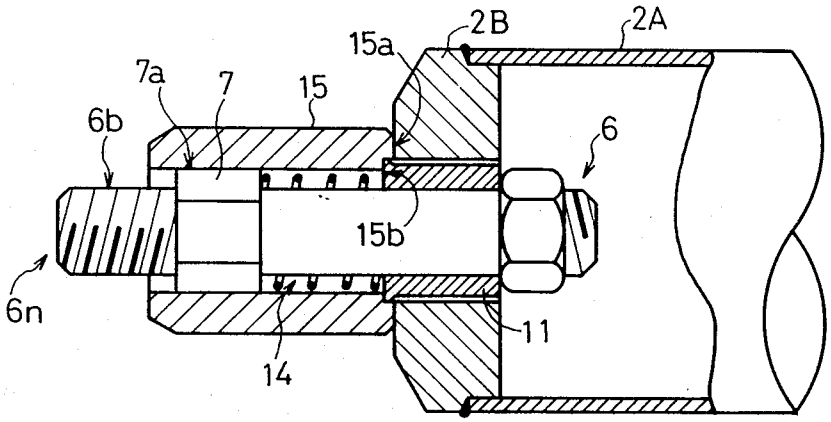

On the other hand, independently of the structure member 2, the spring 14 is fitted on the fastening bolt 6 from the screw end 6*a* thereof, as shown in FIG. 3. Then, the sliding body 6*m* of fastening bolt 6 is inserted into the sliding hole 12 of supporting member 11 from the screw portion 6*a*. In just the state in which the spring 14 extends between the boss 7 and the supporting member 11, the anchor nut 8 is engaged with the screw 6*a* at the maximum engaging position thereof, as shown in FIG. 4. The fastening bolt 6 is inserted into the screw hole 9 of edge cover 2B united wiht the end of each structure pipe 2A, and the supporting member 11 is engaged with the screw hole 9 of edge cover 2B, as shown in FIG. 5. Nails, i.e., projections, of a rotating tool 18, as indicated by broken lines, may be engaged with correspondingly provided hollows 13 and are rotated sufficiently to obtain the desired engagement. When the supporting member 11 is thus fixed to the edge cover 2B, the degree of engaging therewith is adjusted so that the supporting member may project by the distance L from the end face 2*n* of edge cover 2B (as best seen in FIG. 2); then the supporting member 11 is fixed to the edge cover with the adhesive agent applied beforehand. Although a tool may be used as described, with clean or new parts being assembled there may be no need for it and a user may thread in supporting member 11 by hand. The sleeve 15 is then fitted so as to engage with the torque transmitting surfaces 7*a* of boss 7, as indicated in FIG. 6. A highly polymerized absorbent (not illustrated) is applied beforehand to the end face 15*a* and the grooved wall 15*b* of sleeve 15.

Figure 7:
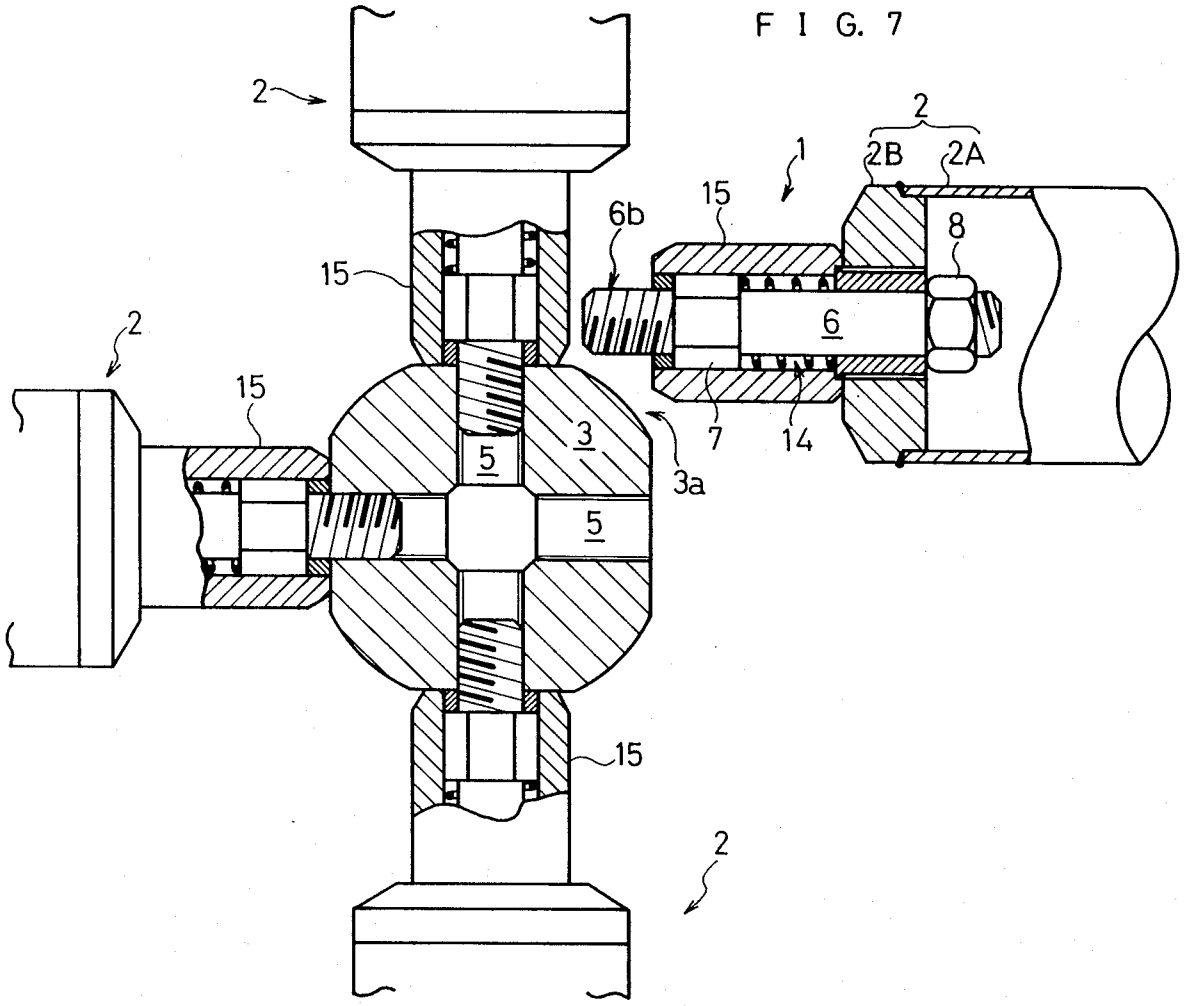
Figure 8:
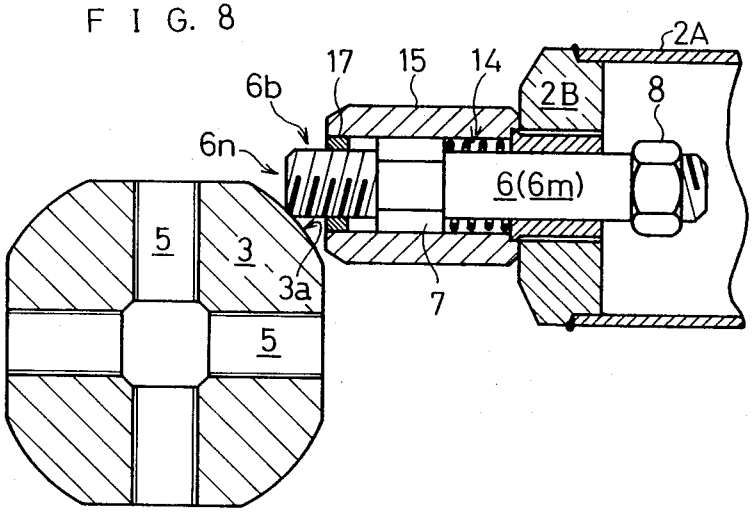
Figure 9:
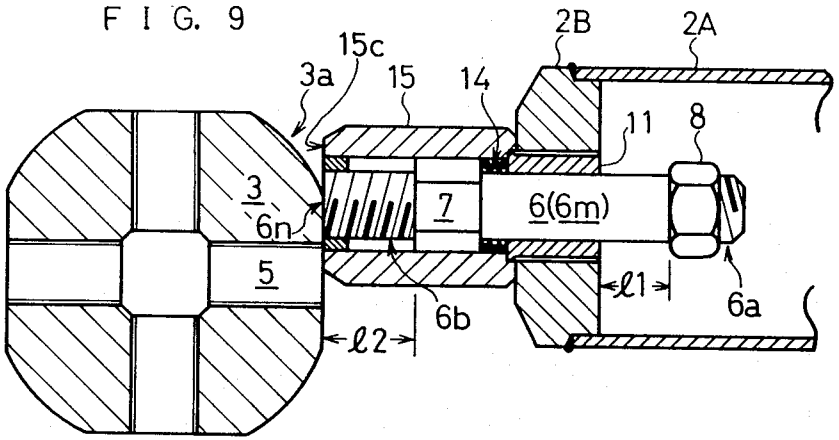
Figure 10:
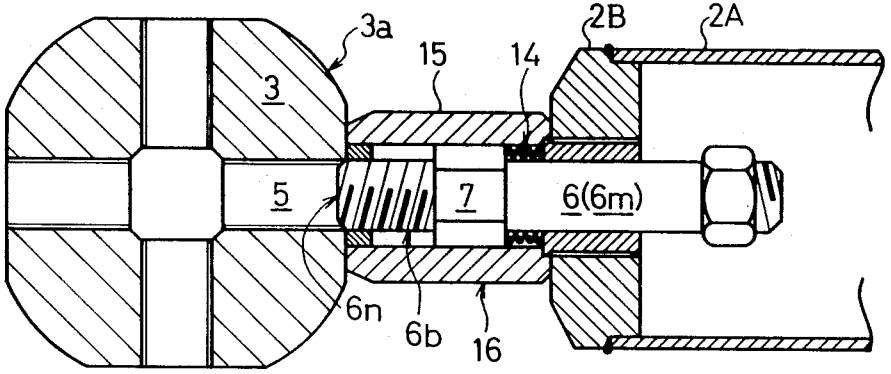

The fastening bolt 6 is pushed into the sleeve 15, contracting the spring 14 therebetween, so that the tip 6*n* of fastening bolt 6 may enter the sleeve 15, and the structure member is disposed between two nodes 3, 3 which have been kept apart at a final assembling length. In this operation, the user need not push the fastening bolt 6 into the sleeve 15. After device 1 is carried to the node 3 as shown in FIG. 7, the tip 6*n* of screw 6*b* of fastening bolt 6 is moved along the spherical surface 3*a* of node 3 as shown in FIG. 8. The fastening bolt 6 enters in the sleeve 15 perfectly, contracting the spring 14 as shown in FIG. 9. The fastening bolt 6 is kept in the sleeve 15 until the tip 6*n* of fastening bolt 6 meets the desired screw hole 5 of node 3. When the tip 6*n* meets said screw hole 5 of node 3, the fastening bolt 6 sticks out owing to the elasticity of the spring 14, therefore, the tip 6*n* will easily enter the screw hole 5 as shown in FIG. 10.

The torquing surfaces 16 formed on the outside of sleeve 15 are then rotated by a spanner engaged therewith, and the fastening bolt 6 is rotated through the boss 7. The screw 6*b* is moved toward the screw hole 5, and hence the fastening bolt 6 is engaged with the node 3, as shown in FIG. 1. While the fastening bolt 6 is so moved, the slidable body 6*m* is supported by the sliding hole 12. Finally, the anchor nut 8 contacts with the supporting member 11.

As shown in FIG. 9, when the tip 6*n* of screw 6*b* exists at the tip 15*c* of sleeve 15, the distance $l_1$ between the anchor nut 8 at the maximum engaging position and the supporting member 11 is shorter than the distance $l_2$ between the boss 7 and the tip 15*c* of sleeve 15. Accordingly, the screw 6*b* can be engaged tightly with the screw hold 5 of node 3. When the screw 6*b* is engaged with the node 3, engaging of the anchor nut 8 with the screw 6*a* is promoted as the screw portion 6*a* has a thread that is formed as counter spiral to the thread of screw portion 6*b*. The screw 6*b* does not advance more as the anchor nut 8 never loosens from the screw 6*a*.

The joining force on the fastening bolt 6 and the node 3 is transmitted ot the edge cover 2B through sleeve 15 and supporting member 11; more exactly, this occurs through the end face 15*a* and the grooved wall 15*b* of sleeve 15 (best seen in FIG. 2). A sealing material 4 is applied to the portion between the sleeve 15 and the edge cover 2B, and the elastic packing 17 held between the boss 7 and the node 3 is compressed. The watertightness on both sides of sleeve 15 is thus attained by the presence of sealing material 4 and the elastic packing 17. As the fastening bolt 6 is covered perfectly with the sleeve 15, it is not exposed to any vapors of chemical treatment, even when such structure members joined with said joint device are used as ceiling beams, especially in the building of, for example, a galvanizing factory. The end face of sleeve 15 is held firmly against node 3 and edge cover 2B even if sealing mechanisms owing to sealing material 4 and elastic packing 17 are not adopted. Therefore, the fastening bolt 6 is rarely exposed to the ambient atmosphere in contrast with conventional joint devices.

When the structure member 2 is removed from the node 3, the sleeve 15 is rotated to the opposite direction. The fastening bolt 6 is moved back, contracting the spring 14, and the tip 6*n* returns to the opening position of screw hole 5 as shown in FIG. 10. The fastening bolt 6 is pushed toward the node 3 by the spring 14, however, as the peripheries of tip 6*n* of screw 6*b* and of the opening of screw hole 5 are rounded off, the fastening bolt 6 can be moved back some more, contracting the spring 14 by sliding the sleeve 15 laterally as shown in FIG. 9. Accordingly, the structure member 2 disposed among the nodes 3, 3 is kept at a final assembling length, and can be removed very easily.

Figure 11:
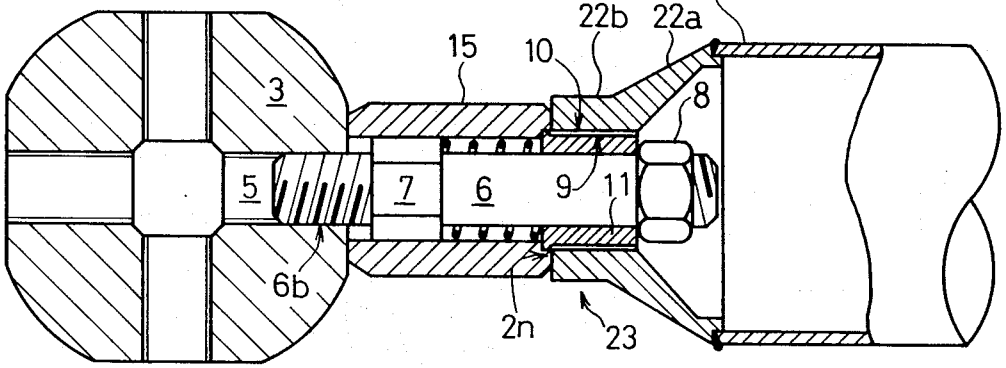
FIG. 11 is a sectional view of the device in another embodiment wherein the structure member provides a different end cover.

Other related embodiments are now described. The edge cover 2B of above-mentioned joint device is a thick disk, but this invention is realized even if the edge cover 22B is formed sub stantially as a cone, as shown in FIG. 11. It consists of a conical portion 22*a* and a cylindrical portion 22*b* having the same diameter as the structure pipe 2A. The desirable exact length of structure member 2 can be sized by cutting of the end face 2*n* of the cylindrical portion 22*b* as needed. The cylindrical portion 22*b* can be utilized as the counter force receiver 23 when the sleeve 15 is rotated, if the exterior form of cylindrical portion 22*b* is hexagonal. Consequently, it serves to facilitate applying of torque to the sleeve 15 easily.

In the above-mentioned examples, an adhesive agent is applied to the portion where the supporting member 11 engages with the edge cover 2B or 22B. This is why the screw 10 is provided with a thread with the same spiral as the screw 6*b* which makes the fastening bolt 6 engage with the node 3. Thereupon, if the supporting member 11 and edge cover 2B or 22B have a counter spiral to the screw 6*b*, a big torque is received by the surfaces contacting with the sleeve 15, when the prescribed maximum torque is applied after the sleeve 15 contacts with the node 3 and the edge cover 2B or 22B. Consequently, the adhesive agent will be necessary if each of the screw threads provides the same right-handed spiral as the screw 6*b* and, moreover, this kind of bonding is sometimes broken by application of a big torque. Nevertheless, such troubles can be prevented if each threaded portion of said screw is provided a left-handed spiral.

As described above in detail, this structure member facilitates application of a big torque easily in order to screw in the fastening bolt through the torquing surfaces of the sleeve. Even when the distance between both nodes becomes a final assembling length after many structure members are thus joined to each other. Each structure member is able to be joined or removed easily by pushing of the fastening bolt into the sleeve owing to the deformation of the spring. Accordingly, it is unnecessary to have a specific order for joining of each structure member and to widen the distance between both nodes in order to join the final structure member, hence the assembling is performed very rapidly. Moreover, the structure members are reliable if the spoiling of the device or sustaining excessive stress thereby is avoided. The fastening bolt is not exposed to atmosphere and watertightness is improved remarkably by applying a highly polymerized absorbent or the like as described. The screw portions of fastening bolt 6, which are important in ensuring durability, do not corrode. The device, consequently, is suitable for use with outdoor structures. Tests have confirmed that the desired watertightness is kept for 24 hours in water 100 mm deep. Moreover, the exact length of the structure member can be sized by means of machining, and the surface treatment thereof therefore becomes easy. As the fastening bolt is not fitted to the structure member during galvanizing, any decrease of the bolt strength caused by galvanizing can be avoided and, therefore, the typical high tension bolt which can not be galvanized will be usable in the invention.

Figure 12:
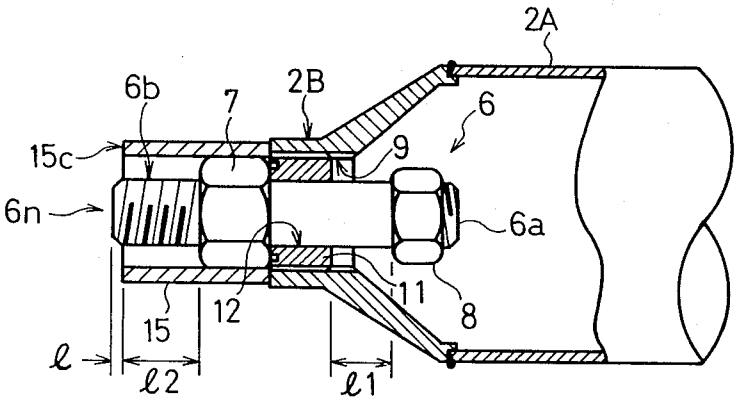
FIG. 12 is a sectional view of yet another embodiment, in which the tip of a fastening bolt projects from an opening of a sleeve.
Figure 13:
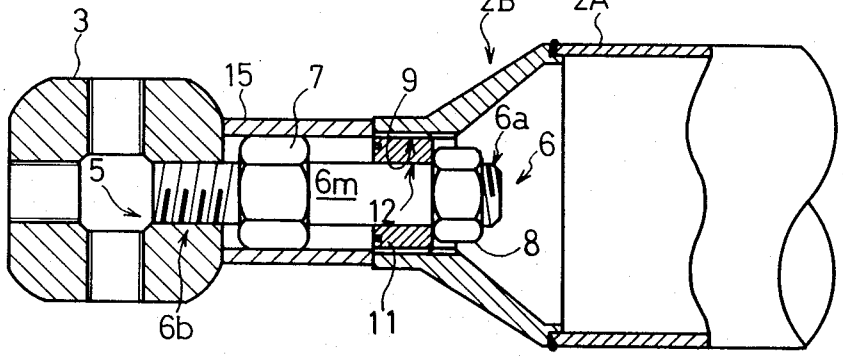
FIG. 13 is a sectional view illustrating a structure member joined to a node according to this invention.

FIGS. 12 and 13 are embodiments without the above-mentioned spring. The joining or removing process can be performed in almost the same manner as described above. The alternative embodiment provides almost the same benefits as the preferred embodiment. In this mechanism, when the boss 7 contacts with the supporting member 11, the distance $l_1$ between the anchor nut 8 at the maximum engaging position of screw 6*a* and the supporting member 11 is shorter than the distance $l_2$ between the boss 7 contacting with the supporting member 11 and the tip 15*c* of sleeve 15. When the screw 6*b* is engaged with the screw hole 5 of node 3 as indicated in FIG. 13, it is necessary for the user to look at the tip of fastening bolt 6, or feel the response owing to meeting the screw hole 5. In order to lead the tip of fastening bolt 6 to the screw hole 5 of node easily, the tip 6*n* of fastening bolt 6 projects from the tip 15*c* of sleeve 15 by a distance at least as shown in FIG. 12, indicating the state previous to being joined. The distance is short, e.g., 3–5 mm.

When the distance between both nodes becomes a final assembling length, the tip of fastening bolt will obstruct joining smoothly, which is why the device provided with the spring 14 is used.

When the fastening bolt 6 is moved in supporting member 11 by said distance $l_1$, the anchor nut 8 will contact with the supporting member 11 as shown in FIG. 13. As the screw 6*a* engaged with anchor nut 8 is given a counter-spiral to the screw 6*b* engaged with the node 3, engaging of anchor nut 8 with screw 6*a* is promoted by screwing up the fastening bolt to the node 3 and, consequently, the fastening bolt 6 does not advance further. Also the boss 7 is moved by the distance $l_1$; however, it is shorter than the distance $l_2$ to the tip 15*c* of sleeve 15. The boss 7, therefore, is not contacted with the node 3, and the fastening bolt 6 will not loosen from the node.

INDUSTRIAL APPLICABILITY

This invention is useful for joining of tightly and closely long structure members to nodes in assembling a truss-structure. This is therefore a suitable device for constructing the ceiling beams and the like in a building.

In this disclosure, there are shown and described only the preferred embodiments of the invention, but, as aforementioned, it is to be understood that the invention is capable of use in various other combinations and environments and is capabale of changes or modifications within the scope of the inventive concept as expressed herein.

I claim:

1. A device for connecting an end of an elongate pipe-like structure member having an internally threaded end, ending at a first contact surface, to a connector node having an internally threaded aperture ending at a second contact surface, comprising:

a bolt having first and second end portions, formed to have oppositely spiralled threads, the threads of said second end portion being adapted to engage with said threaded node aperture, and intermediate therebetween a cylindrical portion and a torque-transmitting portion;

an annular cylindrical bolt-support member, having an internal bore adapted to slidingly receive therethrough said first threaded portion and said cylindrical portion of said bolt, provided along a portion of its length with an external thread adapted for engagement with the internal threads of said structure member end;

a nut means for engaging said first threaded end portion of the bolt, selected to be diametrically larger than said internal bore of the bolt-support member but smaller than a diameter of the internal threads of the structure member end; and a sleeve member having a first end with a first end surface for contacting the first contact surface and a second end with a second end surface for contacting the second contact surface, of the structure member and the node respectively, an internal bore of a cross-section shaped to slidingly receive said torque-transmitting portion of the bolt in torque-transmitting engagement therewith, and an external surface formed to be engaged thereat by a suitable sleeve-engaging tool means for applying torque.

2. A device according to claim 1, further comprising:

spring means disposed along the bolt to provide a separating bias force between the torque-transmitting portion of the bolt and an adjacent end portion of the bolt support member receiving the same.

3. A device according to claim 1, wherein:

an annular central recess is formed in the first end of the sleeve member to receive therein an adjacent end of the bolt-supporting member.

4. A device according to claim 1, further comprising:

an elastic sealing member having an aperture sized to receive the second threaded end portion of the bolt therethrough, of a thickness such that threaded engagement of the bolt with the node causes the sealing member to be sealingly compressed between the second contact surface and the torque transmitting portion of the bolt during use of the device.

5. A device according to claim 1, further comprising:
a quantity of sealing material disposed between the first end surface of the sleeve member and the first contact surface of the structure member end to form a seal thereat during use of the device.

6. A device according to claim 3, further comprising:
a quantity of sealing material disposed between the first end surface of the sleeve member and the first contact surface of the structure member end to form a seal thereat during use of the device, and an additional quantity of said sealing material disposed to simultaneously form a further seal between said adjacent end surface of the bolt-support member and a base surface of said annular recess in said sleeve member.

7. A device according to claim 1, further comprising:
means for preventing rotation of the structure member during application of torque to thread said bolt-support member therein.

8. A device according to claim 7, wherein:
said means for preventing rotation comprises an extended portion of said internally threaded end of the structure member, said extended portion being adapted for application of a holding force thereto.

9. A device according to claim 2, further comprising:
an elastic sealing member having an aperture sized to receive the second threaded end portion of the bolt therethrough, of a thickness such that threaded engagement of the bolt with the node causes the sealing member to be sealingly compressed between the second contact surface and the torque transmitting portion of the bolt during use of the device.

10. A device according to claim 9, further comprising:
a quantity of sealing material disposed between the first end surface of the sleeve member and the first contact surface of the structure member end to form a seal thereat during use of the device.

11. A device according to claim 5, wherein:
said sealing material comprises a highly polymerized material that tends to expand when exposed to moisture.

12. A device according to claim 1, wherein:
said bolt is sized such that when the nut means is fully tightened thereon a first length $L_1$, extending from the nut means toward the adjacent end of the torque-transmitting portion is shorter than a second length $L_2$ extending from the second end of the sleeve member to the end of the torque-transmitting position of the bolt closest thereto when said torque transmitting portion of the bolt and said sleeve member receiving the same are simultaneously in contact with said first contact surface of the structure member.

13. A device according to claim 12, further comprising:
an annular central recess is formed in the first end of the sleeve member to receive therein the adjacent end portion of the bolt-supporting member.

14. A device according to claim 12, further comprising:
an elastic sealing member having an aperture sized to receive the second threaded end portion of the bolt therethrough, of a thickness such that threaded engagement of the bolt with the node causes the sealing member to be sealingly compressed between the second contact surface and the torque transmitting portion of the bolt during use of the device.

15. A device according to claim 12, wherein:
a quantity of sealing material disposed between the first end surface of the sleeve member and the first contact surface of the structure member end to form a seal thereat during use of the device.

16. A device according to claim 15, further comprising:
said sealing material comprising a highly polymerized material that tends to expand when exposed to moisture.

17. A device according to claim 12, further comprising:
means for preventing rotation of the structure member during application of torque to thread said bolt-support member therein.

18. A device according to claim 17, wherein:
said means for preventing rotation comprises an extended portion of said internally threaded end of the structure member, said extended portion being adapted for application of a holding force thereto.

19. A device according to claim 18, wherein:
said sealing material comprises a highly polymerized material that tends to expand when exposed to moisture.

20. A device according to claim 6, wherein:
an annular central recess is formed in the first end of the sleeve member to receive therein the adjacent end portion of the bolt-supporting member;
said sealing material comprises a highly polymerized material that tends to expand when exposed to moisture; and
further comprising means for preventing rotation of the structure member during application of torque to thread said bolt support member therein;

21. A device according to claim 1, wherein:
said bolt support member has an unthreaded end portion ending at an outer end surface that is also formed to be engaged thereat by a torque-applying tool means to facilitate threading of the bolt support member to the internal threads of the structure member.

* * * * *